United States Patent [19]

Delory et al.

[11] 4,243,914

[45] Jan. 6, 1981

[54] CIRCULATING FLUID COOLED DELAY LINE FOR HIGH FREQUENCY TUBES, AND HIGH FREQUENCY TUBES HAVING SUCH A DELAY LINE

[75] Inventors: Bernard Delory; Georges Fleury; Jean-Claude Kuntzmann, all of Paris, France

[73] Assignee: Thomson-CSF, Paris, France

[21] Appl. No.: 22,302

[22] Filed: Mar. 20, 1979

[30] Foreign Application Priority Data

Mar. 24, 1978 [FR] France ..... 78 08673

[51] Int. Cl.[3] ..... H01J 25/34

[52] U.S. Cl. ..... 315/3.5; 313/17; 313/22; 313/30; 315/3.6; 315/39.3

[58] Field of Search ..... 313/36, 30, 45, 17, 313/22; 315/3.5, 39.3, 3.6

[56] References Cited

U.S. PATENT DOCUMENTS

| | | | |
|---|---|---|---|
| 3,070,725 | 12/1962 | Lee et al. | 315/39.3 X |
| 3,211,947 | 10/1965 | Bloom | 315/3.5 X |
| 3,271,615 | 9/1966 | Washburn, Jr. | 315/3.5 |
| 3,274,429 | 9/1966 | Swiadek | 313/36 X |
| 3,317,780 | 5/1967 | Ayers | 315/3.5 |
| 3,529,197 | 9/1970 | Orui | 315/3.5 X |
| 4,137,482 | 1/1979 | Caryotakis et al. | 315/3.5 |

*Primary Examiner*—Saxfield Chatmon, Jr.
*Attorney, Agent, or Firm*—Roland Plottel

[57] ABSTRACT

A delay line for a high frequency tube that is cooled by circulating fluid.

The cooling fluid circulates in a duct (FIG. 3, 10), formed in the space between two sleeves (8 and 9). The sleeves are of non-magnetic material, impervious to the cooling fluid, and have an axis parallel to the axis of the delay line. The first sleeve (8), is vacuum tight, brazed or hard soldered to dielectric supports (2) and, in cross section connects two adjacent supports in a straight line. The second sleeve (9), is cylindrical, and contains the first sleeve to which it is brazed at several points. A focusing device made of permanent magnets is mounted on the second sleeve.

The invention will find use in high frequency tubes.

8 Claims, 5 Drawing Figures

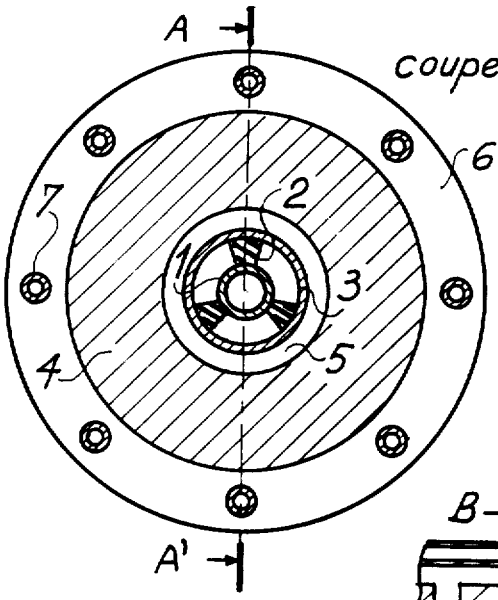
PRIOR ART
FIG_1a
PRIOR ART
FIG_1b
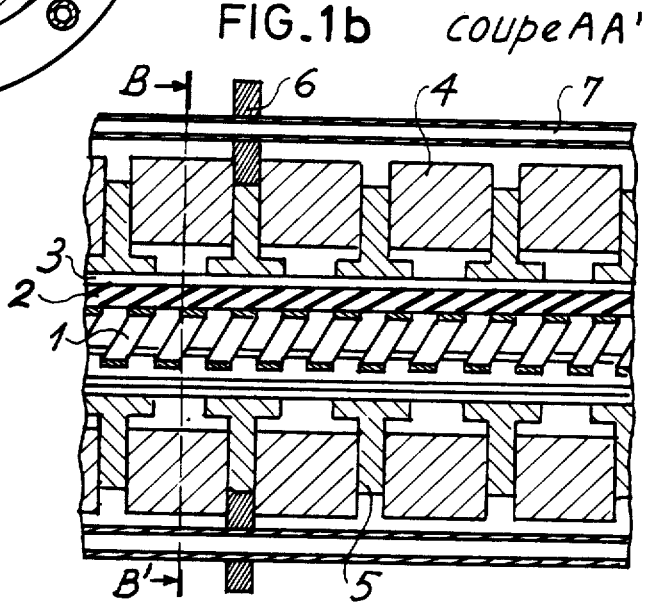
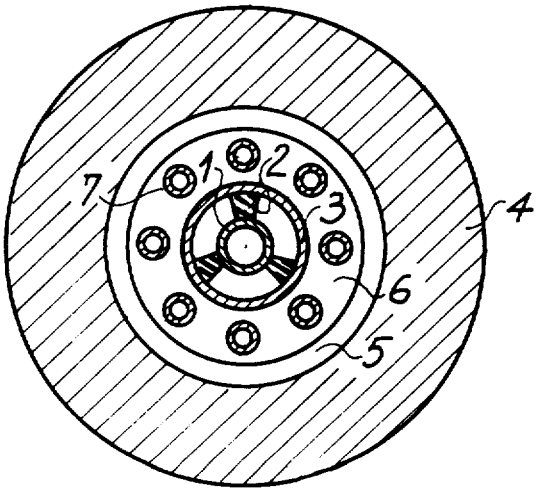
PRIOR ART
FIG_2

CIRCULATING FLUID COOLED DELAY LINE FOR HIGH FREQUENCY TUBES, AND HIGH FREQUENCY TUBES HAVING SUCH A DELAY LINE

The invention relates generally to high frequency tubes, and particularly to a delay line used in high frequency tubes and cooled by a circulating fluid.

The high frequency tubes to which the present invention may be applied includes such tubes as traveling wave tubes or carcinotrons type O, having a delay line in which there is an interaction between an electron beam and electromagnetic wave. The electromagnetic wave propagates along the delay line and its phase velocity is nearly equal to the velocity of the electron beam which travels along the axis of the line.

The delay line can have several structures: helical, ring and bar, ring and loop, etc.

The invention is particularly applicable in those cases where the focusing of the electron beam along the entire length of the interaction space with the electromagnetic wave is brought about by a magnetic field produced by permanent magnets. The invention is directed to cooling of the delay line by a fluid. The delay line is the site of high frequency losses. Moreover, a poor focusing of the electron beam can increase the heating of the delay line. The problem which is presented is the positioning of the ducts or cooling fluid circuit. This positioning is easier when the magnetic field for focusing the electron beam is produced by an electromagnet than when it is produced by larger permanent magnets. In contrast, focusing by permanent magnets has significant advantages, namely light weight and power consumption. Consequently, it is important to get the best position of the cooling ducts around the delay line that is focused by permanent magnets.

When the focusing is done by permanent magnets, it is known in the prior art to position the cooling ducts in one of the following two arrangements. (1) The cooling ducts are mounted on a flange that encircles the permanent magnet focusing device. In this case the efficiency of cooling is small because the thermal resistance between the line and the cooling duct is large. (2) The cooling ducts are mounted, before the focusing device, on a flange made of nonmagnetic material, which circles the cylindrical sleeve that is separated from the delay line by the dielectric supports. The thermal resistance between the line and the cooling ducts is thus much less here than in the previous arrangement. A further difficulty is then present because the focusing device is constituted by alternate groups along the axis of the line, and by permanent magnets and pole faces (the faces of the same polarity of the magnets facing each other). In this arrangement, the focusing device encircles the cooling flange and its internal diameter is increased. The thickness of the magnets is held constant because of magnetic properties so that an increase of their internal diameter causes an increase of the demagnetization field in which these magnets operate. In certain cases, and particularly for high frequencies (I and J bands, for example), the coercive field of the material which makes up the magnets may be involved, even if we use samarium cobalt whose coercive field is very high. Focusing the electron beam is then no longer possible.

Arranging the cooling ducts according to the invention brings about a much more efficient cooling of the delay line than does any other known arrangement. In particular, it permits cooling of a delay line functioning in the I Band, which the prior art arrangements that we have mentioned do not allow. Such cooling is impossible under prior arrangements because these arrangements cannot obtain a focusing field of the electron beam. The arrangement according to the invention does not involve any significant increase in the volume of a tube as is the case in prior art arrangements.

Other objects, features, and results of the invention will become apparent from the following description given in a nonlimiting example and illustrated by the attached figures in which:

FIG. 1A is a transverse view partially in section of a delay line cooled by a circulating fluid of the prior art.

FIG. 1B is a longitudinal cross-sectional view of a delay line of FIG. 1A.

FIG. 2 is a transverse view partially in section of an alternative delay line cooled by a circulating fluid of the prior art.

In the different Figs. the same elements are represented by the same legends.

Figure 3:
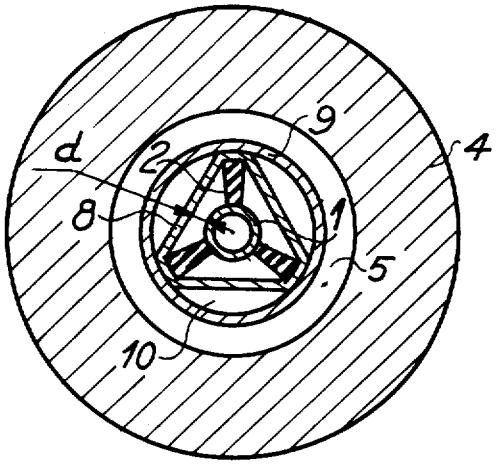
FIG. 3 is a transverse cross-sectional view of a delay line cooled by a circulating fluid according to the invention.

In FIGS. 1A and 2 there is shown, by way of example, a transverse cross-sectional view of a delay line cooled by a circulating fluid as is known in the prior art. In these figures the electron beam is focused by permanent magnets. A delay line 1 that is shown in circular cross section may for example be a helix or more strictly speaking helicoidal. Three supports 2, of dielectric material and good thermal conductors such as aluminum, quartz, boron nitride, or beryllia, are equidistantly positioned on the delay line, and are parallel to the axis of the line. One of the faces of these supports are brazed or hard soldered to the line in order to minimize the thermal resistance at the interface between the line and the supports. The face of the support which is opposite to the one which is brazed onto the line, is generally brazed to a cylindrical sleeve 3. The cylindrical sleeve 3 is watertight, and defines a space on the inside of the cylinder. The cylinder is nonmagnetic and a good conductor of heat and may be made of copper. When the sleeve is metallic it is bound as is the line to a common mass.

FIG. 1B is a longitudiinal cross-sectional view of the delay line along A—A' of FIG. 1A.

In FIG. 1A the focusing device is of permanent magnets positioned on the cylindrical sleeve 3. It is composed by an alternating arrangement along the axis of a line 1 of permanent magnets 4 and pole pieces 5, the like pole faces of the magnets being facing each other. A flange 6 of a material that is a good conductor of heat, copper for example, circles and extends out from the focusing device. It is pierced by and supports tubes 7 in which cooling fluid circulates. The cooling fluid is usually a liquid. As has been noted above, this arrangement of cooling tubes does not assure an efficient cooling of the delay line because the thermal resistance between the line and the tubes is large. The focusing device is generally not brazed to the sleeve 3 and the thermal resistance of the focusing is significant.

In FIG. 2, the flange 6 supporting the cooling tube 7 is set on the collar 3. The flange and the tubes must be of a magnetic material and good conductor of heat, for example copper. The focusing device made up of the permanent magnets 4 and the pole pieces 5 surrounds the flange 6. As it is has been noted previously, in comparison to the preceding arrangement, this arrangement reduces the thermal resistance between line 1 and tubes 7. Thus, it improves the cooling of the line, but it makes it difficult and sometimes impossible to make focusing devices with permanent magnets.

According to the invention, the cooling fluid for the delay line, circulates in a duct constituted by the space made between two sleeves which are impervious to this fluid and which are coaxial with the line. A first sleeve performs the function filled in the previous arrangements of the cylindrical sleeve 3. It is nonmagnetic and ensures vacuum tightness over its interior space. It is in contact with a face of the supports. The supports are of dielectric material and have another face in contact with the delay line. These supports are parallel to the axis of the line and are regularly positioned around its circumference. The first sleeve has no contact with the delay line. The first sleeve according to the invention is different from the prior art sleeves 3 in that its cross section does not have to be circular. The second sleeve surrounds the first, and it is in contact with it at different points and separated from it to define ducts through which circulates the cooling fluid.

The second sleeve is generally cylindrical, of a nonmagnetic material, and on which is mounted the focusing device of permanent magnets. The circular cross section of the second sleeve permits the use of disc-shaped permanent magnets. This shape of the magnets being preferable for the proper focusing of the electron beam.

In FIG. 3 there is shown, by way of an example, a cross sectional view of a delay line, cooled by a circulating fluid according to the invention, and in which the electron beam is focused by permanent magnets.

Here the delay line 1 may, for example, have a helicoidal shape; and the supports 2 of which there are three in number, are regularly positioned around the delay line; they are of a dielectric material, a good conductor of heat.

Supports 2 may be brazed to the line along one of their faces, and brazed along their opposite face to the line on the inside of a first sleeve 8. The contact between the supports 2 and the line 1, and the sleeve 8, may also be brought about by fitting the sleeve 8 onto the supports.

In FIG. 3 where three dielectric supports are shown, the first sleeve 8 covers the face of each support opposite the face of the support in contact with the line, then the sleeve links two adjacent supports in a straight line or plane. Thus its cross section is somewhat triangular. A second sleeve 9 is cylindrical and encircles the first sleeve with which it is in contact at different points (3 in the example of FIG. 3).

The first sleeve 8 and the second sleeve 9 are of nonmagnetic material, for example copper. The technology of the arrangement of the two sleeves shown in FIG. 3 may be made as follows: two copper tubes, one circular, the other substantially triangular, are brazed simultaneously with the supports 2 and the line 1.

The contact between the two sleeves 8 and 9 may thus be effected by brazing, but it is also possible to fit cylinder sleeve 9 on the first sleeve 8.

The cooling fluid circulates in a duct 10 that is formed by the space between the sleeves 8 and 9 and for example may be water. When the first sleeve 8 is a nonmagnetic material, that is a good thermal conductor, but not metallic, then the cooling fluid must be a dielectric.

The focusing device constituted by permanent magnets 4 and pole pieces 5 is fitted on the cylindrical sleeve 9.

The thermal resistance between the delay line 1 and the duct 10 in which the cooling fluid circulates is clearly less with this invention's arrangement than with known prior art arrangements. Brazing the supports to the line and to the first sleeve contribute to reduce the thermal resistance. The cooling of the delay line in accordance with the invention is thus efficient.

The first sleeve 8 does not modify in any noticeable way the high frequency characteristics of the delay line because so much of the helix mass capacity remains weak. It is known that the introduction of a large helix mass capacity between two dielectric supports changes the high frequency characteristics and particularly diminishes the dispersion of the delay line. If in order to increase the high frequency band, a reduction of the dispersion of the delay line is desirable, then the distance d between the line and the wall of the first sleeve 8, in a region where it is not in contact with the dielectric support, should be minimized. It is noted that this reduction of the dispersion of the delay line is accompanied by a reduction in its efficiency, which is a disadvantage.

The arrangement of the cooling ducts according to the invention only increases slightly (equal to the thickness of the first sleeve 8) the internal diameter of the focusing device represented in FIG. 1. Thus it avoids the drawbacks inherent in the device shown in FIG. 2. The arrangement according to the invention of the cooling ducts of a delay line permits a reduction of 30 to 40 percent of the overall size of the tube when compared with the arrangement of prior art cooling ducts. This reduction in volume is important, and especially so in those tubes which are airborne, in airplanes, missiles, and rockets.

The cooling ducts 10 are connected to input and output circuits of cooling fluid (not shown). These connections can be made by going through the focusing system. It is moreover preferable to place them near that part of the tube next to the gun producing the electron beam and next to the collector which receiving this beam.

Figure 4:
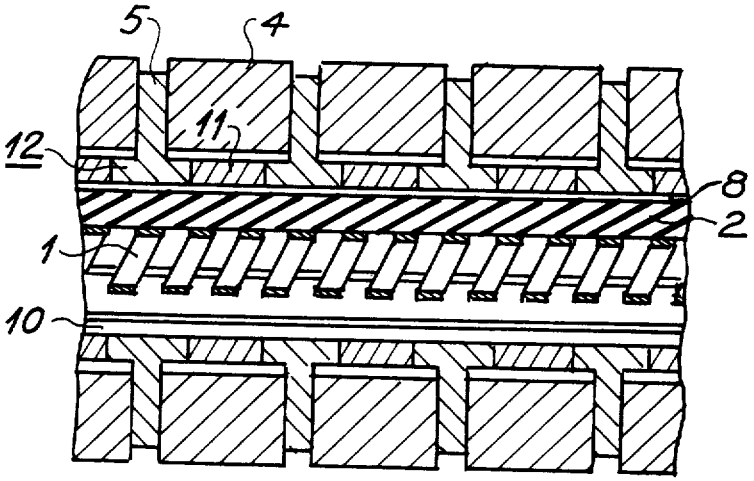
FIG. 4 is a longitudinal cross-sectional view of an alternative delay line cooled by a circulating fluid of the invention.

FIG. 4 shows a longitudinal cross-sectional view of an alternative embodiment of the delay line cooled by a circulating fluid according to the invention.

In this embodiment, the second sleeve is modified. The second sleeve's function is to assure the airtightness (i.e. seal) of the cooling fluid. When focusing is done by permanent magnets, the second sleeve's function is also to constitute a cylindrical envelope, supporting the focusing device, for the unit comprised by the line, first sleeve, cooling ducts. The second sleeve shown in FIG. 4 where it is represented generally by legend 12, includes the pole pieces 5 of the focusing device of permanent magnets. The second sleeve also includes an alternating arrangement along the axis of the delay line of cylinders of nonmagnetic material 11, for example copper and cylinders of magnetic material, soldered end to end. The cylinders of magnetic material carry in their center a flange that is in fact the same as the pole pieces 5 of the focusing device. The disc-shaped permanent magnets 4 are inserted between two successive flanges, with the same poles of the magnet facing each other.

The second sleeve 12, as the second sleeve 9, may be in contact with the first sleeve 8 by brazing or simply by fitting it onto the first sleeve 8.

This embodiment has the advantages of reducing the internal diameter of the focusing device, and those of the disc-shaped permanent magnets 4. At high frequencies, for example the I and J Bands, it is important to diminish this diameter to a maximum. This embodiment has the additional advantage of further contributing to the reduction of the high frequency tube's volume.

We claim:

1. A delay line having a cooling duct comprising
a delay line;
supports;
a first sleeve;
a second sleeve;
said supports having a face in contact with the outer surface of said delay line and another face in contact with an inner surface of said first sleeve;
said first sleeve being vacuum tight on its inside and impervious to a cooling fluid on its outside;
said second sleeve surrounding said first sleeve, and spaced therefrom to provide at least one duct between the two sleeves;
said supports of dialectric material being equally spaced about said line and parallel to said lines axis;
said first sleeve being of non magnetic material and coaxial with said delay line, and being in contact with said supports and linking to adjacent supports in a straight line or plane; and
said second sleeve being circular in cross section, and impervious to a cooling fluid, and being in contact with said first sleeve in front of said supports.

2. A delay line according to claim 1, wherein the second sleeve (9) is a cylinder, of nonmagnetic material, on which is mounted a focusing device of permanent magnets made up of alternating pairs along the axis of the delay line (1) of pole pieces (5) and permanent magnets (4), the faces of the same polarity of the magnets facing each other.

3. A delay line according to claim 1 wherein the second sleeve (12) comprises an alternating arrangement along the axis of the delay line (1) of cylinders of non-magnetic material (11) and cylinders of magnetic material, soldered one to another; the cylinders of magnetic material having in their center a flange also of magnetic material and forming the pole pieces (5) of the focusing device, the focusing device also having discs of permanent magnets (4) interspersed between two adjacent flanges, the faces of the same polarity of the magnets facing each other.

4. A delay line according to claim 1, or 2, or 3 wherein the contact between the supports (2) and the delay line (1) and the first sleeve (8) is done by brazing or hard soldering.

5. A delay line according to claim 1, or 2, or 3 wherein the contact between the first sleeve (8) and the second sleeve (9) is done by brazing or hard soldering.

6. A delay line according to claim 1, or 2, or 3, in a high frequency tube, said tube having said delay line with an interaction between a beam of electrons and an electromagnetic wave propagating on the line, the beam of electrons being focused on the axis of the line by a focusing device, wherein the connection between the ducts (10), through which circulates the cooling fluid and the feeding circuit and the output circuit of the fluid is through the focusing device.

7. A delay line according to claim 1, or 2, or 3, in a high frequency tube, said tube having said delay line with an interaction between a beam of electrons and an electromagnetic wave propagating on the line, the beam of electrons being focused on the axis of the line by a focusing device, wherein the connection between the ducts (10), through which circulates the cooling fluid and the feeding circuit and the output circuit of the fluid is through a bottle of the tube next to a gun which produces the electron beam and next to a collector which receives this beam.

8. A high frequency tube including a delay line with improved cooling comprising
(a) a delay line;
(b) three supports of dialetric material, equally spaced about said line and parallel to said line's axis, and having one face in contact with said line;
(c) a first sleeve of nonmagnetic material, having an approximately triangular cross section and a surface with angle edges and flat sides therebetween, said sleeve being coaxial with said delay line, with the inside of the angle edges being in contact with one face of said supports opposite that face in contact with said line, said sleeve being vacuum tight on its inside and impervious to a cooling fluid on its outside;
(d) a second sleeve circular in cross section surrounding said first sleeve, and impervious to said cooling fluid, said two sleeves being in contact with each other along said angle edge of said first sleeve, and thus providing three spaces between the side walls of said second sleeve and the flat sides of said first sleeve and thus adapted to receive the cooling fluid to flow therethrough;
(e) and said sleeve adapted to carry on its outer periphery a permanent magnet focusing device.

* * * * *